US008662960B2

(12) United States Patent
Inatani et al.

(10) Patent No.: US 8,662,960 B2
(45) Date of Patent: Mar. 4, 2014

(54) METHOD FOR VIBRATION POLISHING VEHICLE WHEEL

(75) Inventors: Shujiro Inatani, Osaka (JP); Tomoyuki Murakami, Osaka (JP)

(73) Assignee: Ray's Engineering Co., Ltd, Osaka (JP)

( * ) Notice: Subject to any disclaimer, the term of this patent is extended or adjusted under 35 U.S.C. 154(b) by 517 days.

(21) Appl. No.: 12/913,978

(22) Filed: Oct. 28, 2010

(65) Prior Publication Data

US 2011/0136410 A1 Jun. 9, 2011

(30) Foreign Application Priority Data

Dec. 4, 2009 (JP) ..... 2009-276056

(51) Int. Cl.
*B24B 1/00* (2006.01)

(52) U.S. Cl.
USPC ..... 451/34; 451/36; 451/51

(58) Field of Classification Search
USPC ..... 451/36, 34, 51, 327, 328, 329
See application file for complete search history.

(56) References Cited

U.S. PATENT DOCUMENTS 5,593,339 A * 1/1997 Yam et al. ..... 451/36
5,857,901 A * 1/1999 LaPoint ..... 451/113
6,572,458 B2 * 6/2003 Lim ..... 451/113
6,688,953 B2 * 2/2004 Kawasaki et al. ..... 451/327
6,729,937 B2 * 5/2004 Kawasaki ..... 451/10
6,918,818 B2 * 7/2005 Rudiger ..... 451/36
6,962,522 B1 * 11/2005 Kawasaki et al. ..... 451/113
7,048,613 B2 * 5/2006 Rudiger ..... 451/36
2002/0077047 A1 6/2002 Kawasaki et al.
2005/0136802 A1 6/2005 Rudiger

FOREIGN PATENT DOCUMENTS

JP 11-216660 8/1999
JP 2001-353654 12/2001
JP 2003-136394 5/2003

OTHER PUBLICATIONS

Extended European Search Report for Application No. 10015199.2 mailed on Apr. 14, 2011.

* cited by examiner

*Primary Examiner* — Maurina Rachuba
(74) *Attorney, Agent, or Firm* — Turocy & Watson, LLP

(57) ABSTRACT

A method for polishing a vehicle wheel, the wheel includes a plurality of holes and a cylindrical rim. A polishing media storage tank holding abrasive media is vibrated to cause the medium to flow in an upwardly or downwardly vortex. The vehicle wheel is dipped into the medium such that the rim portion is disposed between the upward or downward flow of the medium, to polish the wheel.

4 Claims, 6 Drawing Sheets

METHOD FOR VIBRATION POLISHING VEHICLE WHEEL

BACKGROUND OF THE INVENTION

1. Field of the Invention

The present invention relates to a method for vibration polishing a vehicle wheel.

2. Description of the Related Art

Conventionally, for example, the following techniques are disclosed as a technique of polishing the vehicle wheel.

In the polishing technique disclosed in Japanese Unexamined Patent Publication No. 11-216660, the vehicle wheel attached to a leading end portion of a rotating shaft is inserted in a polishing medium storage tank in which a polishing medium is stored, the rotating shaft is circularly vibrated or vibrated from front to back and from side to side along a plane including a shaft center of the rotating shaft.

In the polishing technique disclosed in Japanese Unexamined Patent Publication No. 2001-353654, the vehicle wheel attached to one end side of the rotating shaft is inserted in a tank in which the polishing medium is stored, while the vehicle wheel is rotated about the shaft center of the rotating shaft, the vehicle wheel is inclined with respect to a horizontal plane and linearly moved.

In the polishing technique disclosed in Japanese Unexamined Patent Publication No. 2003-136394, a workpiece support shaft is rotated about the shaft center while a front face of the vehicle wheel attached to a leading end of the workpiece support shaft faces a flow of the polishing medium that is caused to flow by proper means in the polishing medium storage tank, and a baffle member is placed near a lower portion in a rear surface of the vehicle wheel.

The above-described conventional techniques increase an amount of movement of the polishing medium to an inside surface of the vehicle wheel having a complicated three-dimensional shape. However, the flow of the polishing medium into the inside surface of the vehicle wheel is still insufficiently activated. Particularly a surface pressure of the polishing medium can insufficiently act on a window hole in a disc portion of the vehicle wheel, and burrs of the window hole cannot well be polished. Therefore, it is difficult to evenly polish the whole internal and external surfaces of the vehicle wheel, and it is also difficult to achieve further shortening of a polishing time.

SUMMARY OF THE INVENTION

In view of the foregoing, the present invention provides a method for vibration polishing a vehicle wheel in which the whole internal and external surfaces of the vehicle wheel can evenly be polished in a shorter time than ever before while the window hole of the disc portion is well polished.

According to the present invention, there is provided a method for polishing a vehicle wheel having a three-dimensional shape, the vehicle wheel including a disc-shaped disc portion in which a plurality of window holes are provided and a cylindrical rim portion that is located around the disc portion, the method comprising:

oscillating a bottomed cylindrical polishing medium storage tank to vibrate the polishing medium storage tank, a polishing medium being stored in the polishing medium storage tank; causing the polishing medium in the polishing medium storage tank to flow in a vortex manner; generating a convection in which the polishing medium flows downward in a center portion of the vortex while flowing upward in an outer circumferential portion or a convection in which the polishing medium flows upward in the center portion of the vortex while flowing downward in the outer circumferential portion;

connecting a support shaft from a back side of the vehicle wheel; transversely situating the vehicle wheel with a rear surface of the disc portion oriented upward; dipping the vehicle wheel in the polishing medium of the polishing medium storage tank such that the rim portion is disposed between an upward flow and a downward flow of the polishing medium by the convection; causing the polishing medium to flow outside and inside the vehicle wheel; causing the polishing medium to flow so as to pass through the window holes of the disc portion; and vibrating the vehicle wheel through the support shaft to vibration polishing the vehicle wheel.

According to the above-described configuration, the polishing medium can be brought into active contact with not only the outside surface of the vehicle wheel but also the inside surface by the vortex flow of the polishing medium, which is generated by the vibration of the polishing medium storage tank, and the convection of the vertical flow of the polishing medium, and the polishing medium can also be brought into active contact with the window holes of the disc portion by the vortex flow of the polishing medium and the convection. Further, the surface pressure and density of the polishing medium that comes into contact with the outside surface, inside surface, and window hole of the vehicle wheel can increase by vibrating the vehicle wheel through the support shaft.

Accordingly, the whole inside and outside surfaces of the vehicle wheel having the complicated three-dimensional shape can evenly be polished, the burrs of the window hole can be taken well, and the polishing can be performed in a shorter time than ever before.

Preferably, the vehicle wheel is dipped in the polishing medium in the polishing medium storage tank to a depth in which the polishing medium moves between a center portion and an outer circumferential portion in a bottom portion of the polishing medium storage tank located below the vehicle wheel while the polishing medium exceeds an upper end of the rim portion to move between the outside and the inside of the vehicle wheel.

Therefore, the polishing medium in the polishing medium storage tank moves securely and well between the center portion and the outer circumferential portion in the upper and lower portions of the vehicle wheel, so that the convection of the polishing medium can securely be generated along the inside and outside surfaces of the vehicle wheel.

Preferably, a diameter of the polishing medium storage tank is set to 1.2 to 1.8 times a rim diameter of the vehicle wheel.

When the diameter of the polishing medium storage tank is lower than 1.2 times the rim diameter of the vehicle wheel, possibly the convection of the polishing medium is actively generated only inside the vehicle wheel. When the diameter of the polishing medium storage tank exceeds 1.8 times the rim diameter of the vehicle wheel, possibly the convection of the polishing medium is actively generated only outside the vehicle wheel. Accordingly, when the diameter of the polishing medium storage tank is set to 1.2 to 1.8 times the rim diameter of the vehicle wheel, the convection of the polishing medium can securely be generated along the inside and outside surfaces of the vehicle wheel.

Preferably, the vehicle wheel is located coaxially with a center line of the polishing medium storage tank, and the vehicle wheel is vibrated by vertical movement of the support shaft.

Therefore, the surface pressure and density of the polishing medium that comes into contact with the outside surface, inside surface, and window hole of the vehicle wheel can increase.

Preferably, the vehicle wheel is located coaxially with a center line of the polishing medium storage tank, and the vehicle wheel is vibrated by oscillating the support shaft in relation to the polishing medium storage tank.

Therefore, the surface pressure and density of the polishing medium that comes into contact with the outside surface, inside surface, and window hole of the vehicle wheel can increase.

DETAILED DESCRIPTION OF THE PREFERRED EMBODIMENTS

First Embodiment

Figure 1:
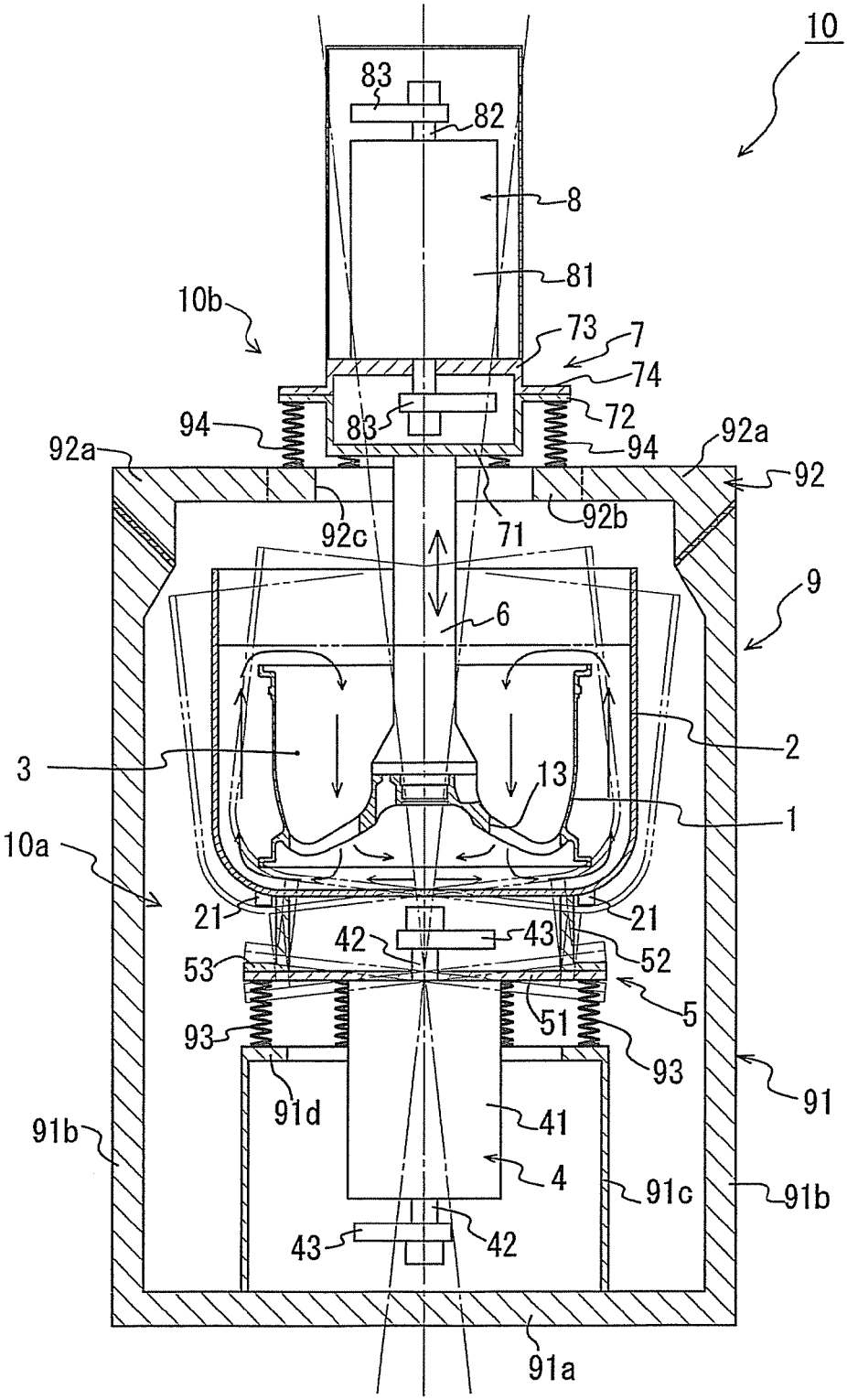
FIG. 1 is a sectional view illustrating an entire configuration of a vehicle wheel vibration polishing apparatus according to a first embodiment of the present invention.
Figure 2:
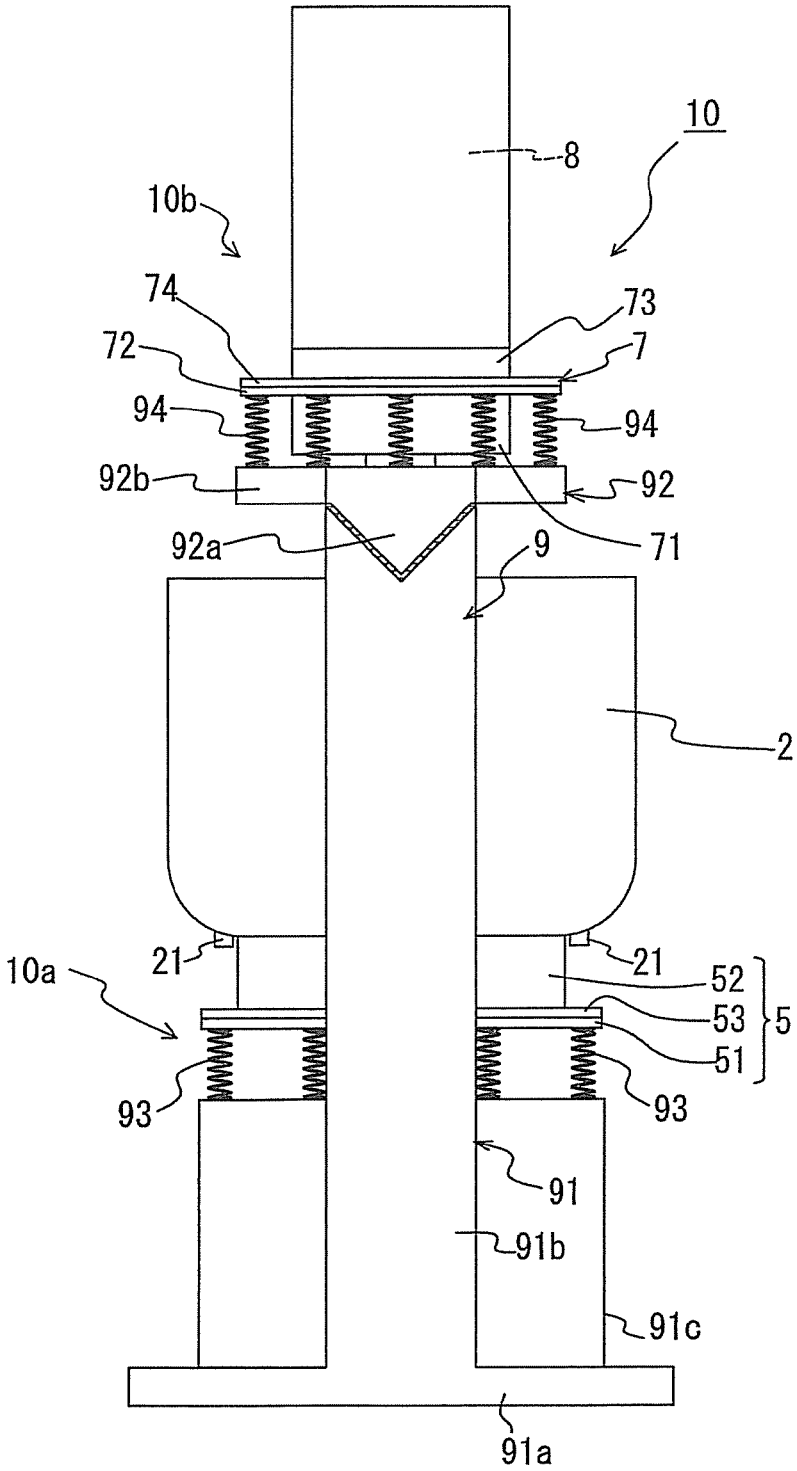
FIG. 2 is a side view illustrating the entire configuration of the vehicle wheel vibration polishing apparatus of the first embodiment.
Figure 4:
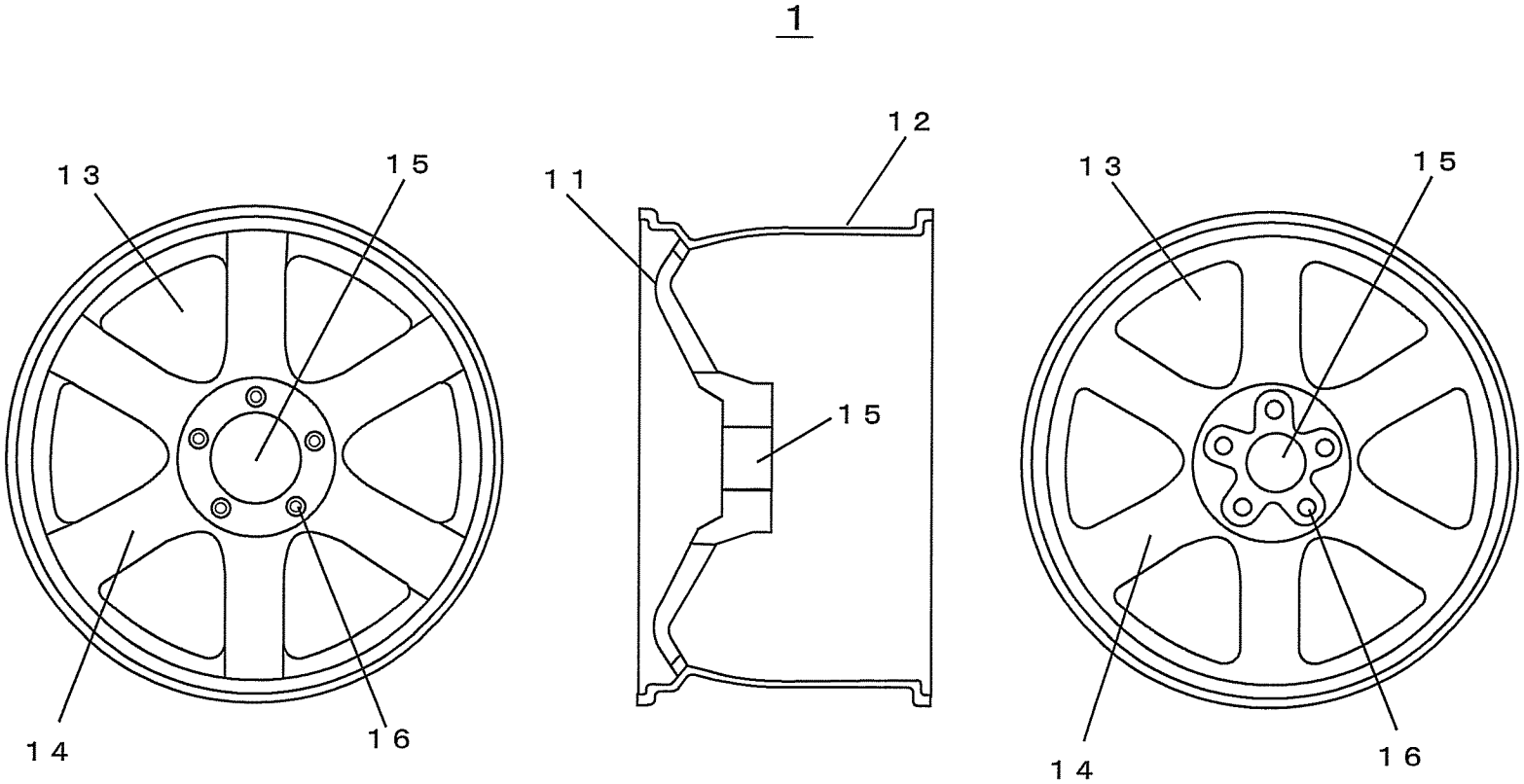
FIG. 4 is an explanatory view illustrating an appearance configuration of a vehicle wheel.

As illustrated in FIGS. 1 and 2, a vibration polishing apparatus 10 of a first embodiment polishes a vehicle wheel 1 that is produced by casting or forging and made of a light alloy such as an aluminum alloy. The vibration polishing apparatus 10 includes a lower unit 10*a*, an upper unit 10*b*, and a base 9 on which the lower and upper units 10*a* and 10*b* are placed. For example, as illustrated in FIG. 4, the vehicle wheel 1 that becomes a workpiece has a three-dimensional shape in which a cylindrical rim portion 12 is provided in an outer circumference of a disc portion 11, a plurality of window holes 13 and spokes 14 are provided in the disc portion 11, a center hole 15 is provided in a hub of the center of the disc portion 11, and a plurality of hole portions 16 for attaching bolts are provided around the center hole 15. The number of vehicle wheel 1 may be formed by one piece, two pieces, three pieces, and the like.

The base 9 includes a base frame 91 and a sub-frame 92. The base frame 91 includes a circular bottom plate portion 91*a*, two long-plate-shaped pillar portions 91*b*, and a tubular support table 91*c*. The pillar portions 91*b* rise up from an edge portion of the bottom plate portion 91*a* while being opposite each other. The support table 91*c* is provided in a protruding manner at the center of the bottom plate portion 91*a* and includes a flange portion 91*d* extending inward toward an opening at an upper end thereof. The sub-frame 92 includes leg portions 92*a* and circular-plate-shaped support plate portions 92*b*. The leg portions 92*a* are connected to the pillar portions 91*b*, respectively. The support plate portions 92*b* couple to the leg portions 92*a* and include a support shaft insertion hole 92*c* in the center thereof.

As illustrated in FIG. 1, an upper end portion of the pillar portion 91*b* in the base frame 91 is formed such that a thickness is thickened, and the upper end portion is formed so as to include a plurality of wedge-shaped inclined surfaces. The leg portion 92*a* in the sub-frame 92 includes a portion that extends horizontally from an edge portion of the support plate portion 92*b* and a portion that is bent downward from the horizontal portion, a thickness of the bent portion is equal to a thickness of the upper end portion of the pillar portion 91*b*, and the and the sub-frame 92 is formed into the wedge shape so as to be fitted in the upper end shape of the pillar portion 91*b*. Accordingly, the upper end of the pillar portion 91*b* and the lower end of the leg portion 92*a* engage each other, whereby the movement of the sub-frame 92 is blocked in any direction of the horizontal direction.

The lower unit 10*a* includes a polishing medium storage tank 2, a lower-side support frame 5, a lower-side vibration motor 4, and a lower-side support spring (lower-side elastic member) 93. The polishing medium storage tank 2 is placed in the base frame 91 and has a polishing medium 3 stored therein. The lower-side support frame 5 is attached to a lower portion of the polishing medium storage tank 2. The lower-side vibration motor 4 is attached to the lower-side support frame 5. The lower-side support spring 93 is attached to the lower-side support frame 5 and supports the polishing medium storage tank 2. Any medium, such as a plastic medium and a ceramic medium, which is usually used can be used as the polishing medium 3. A material, a shape, and a size of the polishing medium 3 can arbitrarily be selected according to polishing finishing. The vibration polishing performed by the vibration polishing apparatus 10 can be applied to both wet polishing and dry polishing.

The polishing medium storage tank 2 in which the polishing medium 3 is stored is formed into a bottomed cylindrical shape, and the vehicle wheel 1 is put in the polishing medium storage tank 2 from an opening portion at the upper end of the polishing medium storage tank 2. In the bottom surface of the polishing medium storage tank 2, a plurality of drain outlets 21 are formed at equal intervals in a circumferential direction at an outer circumferential edge. The drain outlets 21 are opened when only water is drained from the polishing medium storage tank 2 in performing wet polishing. Accordingly, the drain outlet is formed into a size having an opening area where the polishing medium 3 does not drop, and a filter is disposed in the drain outlet 21 to drain only the water such that the polishing medium 3 does not drop when the polishing medium 3 having the small particle diameter is used.

The lower-side vibration motor 4 includes a body case 41 in which a rotor is accommodated, a rotating shaft 42 is connected to a motor rotating shaft, and imbalance weights 43 are attached to both end portions of the rotating shaft 42. The rotating shaft 42 is disposed coaxially with the center of the polishing medium storage tank 2, and the rotating shaft 42 is disposed such that the shaft center of the rotating shaft 42 is oriented toward a vertical direction.

One of the imbalance weights 43 is heavier than the other, or angles of eccentric positions of the imbalance weights 43 are deviated with respect to the shaft center, whereby the rotating shaft 42 is oscillated such that the upper end of the rotating shaft 42 draws a large circular orbit when the lower-side vibration motor 4 is driven. When the rotating shaft 42 is oscillated, the polishing medium storage tank 2 is oscillated by wobbling of the rotating shaft 42 to generate a three-dimensional vibration. The three-dimensional vibration causes the polishing medium 3 in the polishing medium storage tank 2 to flow in a vortex manner, and the three-dimensional vibration can generate a convection flow in which the polishing medium 3 flows downward in the center portion of the vortex while flowing upward in the outer circumferential portion or a convection flow in which the polishing medium 3 flows upward in the center portion of the vortex while flowing downward in the outer circumferential portion. The lower-side vibration motor 4 is driven during the work that inserts the vehicle wheel 1 in the polishing medium storage tank 2, the polishing operation, and the work that takes out the vehicle wheel 1.

The lower-side support frame 5 includes a circular-plate-shaped motor fixing plate 51 and a tubular storage tank support cylinder 52. The upper end portion of the rotating shaft 42 is inserted in the center of the motor fixing plate 51, and the body case 41 of the lower-side vibration motor 4 is fixed to a lower surface of the motor fixing plate 51. The storage tank support cylinder 52 includes a flange portion 53 that is fixed to the edge portion of the motor fixing plate 51.

While the lower-side vibration motor 4 is fixed to the motor fixing plate 51, the flange portion 53 of the storage tank support cylinder 52 is fixed to the outer circumferential edge of the upper surface of the motor fixing plate 51, and the bottom surface of the polishing medium storage tank 2 is fixed to the upper end of the storage tank support cylinder 52. Therefore, the lower-side vibration motor 4 is supported below the polishing medium storage tank 2 with the lower-side support frame 5 interposed therebetween.

The lower-side support frame 5 is supported by the base 9 with the lower-side support spring 93 interposed therebetween. Specifically, the lower-side support spring 93 including eight coil springs is disposed between the lower surface of the motor fixing plate 51 in the lower-side support frame 5 and the upper surface of the flange portion 91*d* of the support table 91*c* in the base frame 91, whereby the lower-side support frame 5 is supported by the base 9 with the lower-side support spring 93 interposed therebetween.

When the lower-side support frame 5 is supported by the base 9 with the lower-side support spring 93 interposed therebetween, the lower-side vibration motor 4 is disposed in the tubular support table 91*c*, and the polishing medium storage tank 2 is disposed above the support table 91*c*. Therefore, the lower-side vibration motor 4 and the polishing medium storage tank 2 are elastically supported by the base 9. When the lower-side vibration motor 4 is driven, the lower-side support spring 93 expands and contracts according to the driving of the lower-side vibration motor 4, and the polishing medium storage tank 2 generates the vibration of the three-dimensional movement.

The upper unit 10*b* includes the support shaft 6, an upper-side support frame 7, an upper-side vibration motor 8, and an upper-side support spring (upper-side elastic member) 94. The support shaft 6 is placed in the sub-frame 92, and the vehicle wheel 1 is attached to the lower end of the support shaft 6. The upper end of the support shaft 6 is fixed to the upper-side support frame 7. The upper-side vibration motor 8 is attached to the upper-side support frame 7. The upper-side support spring 94 is attached to the upper-side support frame 7 to support the support shaft 6.

The lower end of the support shaft 6 is tightened in the center hole 15 from the rear surface side of the disc portion 11 of the vehicle wheel 1, the rear surface of the disc portion 11 is oriented upward, and the vehicle wheel 1 is dipped in the polishing medium 3 in the polishing medium storage tank 2 while situated transversely.

The upper-side vibration motor 8 includes a body case 81 in which a rotor is accommodated, and the motor rotating shaft of the upper-side vibration motor 8 is connected to a rotating shaft 82. Imbalance weights 83 are attached to both end portions of the rotating shaft 82. The rotating shaft 82 is disposed coaxially with the center of the polishing medium storage tank 2, and the rotating shaft 82 is disposed such that the shaft center of the rotating shaft 82 is oriented toward the vertical direction.

The upper-side support frame 7 includes a support shaft fixing portion 71 and a motor fixing portion 73. The support shaft fixing portion 71 includes a first flange 72 that is formed into bottomed cylindrical shape having a circular bottom surface and is projected toward the outside at the upper end thereof. The opening of the support shaft fixing portion 71 is covered with the motor fixing portion 73, the motor fixing portion 73 includes an insertion hole in the central portion thereof, the rotating shaft 82 connected to the motor rotating shaft of the upper-side vibration motor 8 is inserted in the insertion hole, and the motor fixing portion 73 includes a second flange 74 that is overlapped with the first flange 72.

In the upper-side support frame 7, the upper end of the support shaft 6 is fixed to the center portion of the bottom surface of the support shaft fixing portion 71, and the body case 81 of the upper-side vibration motor 8 is fixed to the upper surface of the motor fixing portion 73. The first flange 72 and the second flange 74 are fixed while overlapped with each other, whereby a space is formed by the support shaft fixing portion 71 and the motor fixing portion 73. The lower end portion of the rotating shaft 82 and the imbalance weight 83 on the lower portion side are disposed in the space. The shaft center of the support shaft 6 and the shaft center of the rotating shaft 82 are coaxially disposed.

The upper end of the support shaft 6 is fixed to the lower surface of the upper-side support frame 7, and the upper-side vibration motor 8 is fixed to the upper surface of the upper-side support frame 7, whereby the vibration generated by driving the upper-side vibration motor 8 is transmitted to the support shaft 6 through the upper-side support frame 7.

The upper-side support frame 7 is supported by the base 9 with the upper-side support spring 94 interposed therebetween. Specifically, the upper-side support spring 94 including eight coil springs is disposed between the lower surface of the first flange 72 of the support shaft fixing portion 71 in the upper-side support frame 7 and the upper surface of the support plate portion 92*b* in the sub-frame 92, whereby the upper-side support frame 7 is supported by the base 9 with the upper-side support spring 94 interposed therebetween.

When the upper-side support frame 7 is supported by the base 9 with the upper-side support spring 94 interposed therebetween, the support shaft 6 is inserted in the support shaft insertion hole 92*c* formed in the support plate portion 92*b* of the sub-frame 92, and the upper-side vibration motor 8 is disposed above the support plate portion 92*b*. A size of the support shaft insertion hole 92*c* formed in the support plate portion 92*b* is formed such that the support shaft fixing portion 71 of the upper-side support frame 7 is also inserted in the support shaft insertion hole 92*c* when the upper-side support frame 7 is vertically vibrated by the expansion and contraction of the upper-side support spring 94. Therefore, the upper-side vibration motor 8 and the support shaft 6 are elastically supported by the base 9. When the upper-side vibration motor 8 is driven, the upper-side support spring 94 expands and contracts by the vibration, and the support shaft 6 is vertically vibrated.

A method for vibration polishing the vehicle wheel 1 using the vibration polishing apparatus 10 will be described below.

The lower-side vibration motor 4 is driven to oscillate the polishing medium storage tank 2, the polishing medium 3 in the polishing medium storage tank 2 is caused to flow in the vortex manner, and the convection flow in which the polishing medium 3 flows downward in the center portion of the vortex while flowing upward in the outer circumferential portion (see FIG. 3) or the convection flow in which the polishing medium 3 flows upward in the center portion of the vortex while flowing downward in the outer circumferential portion is generated. A flowing direction of the vortex and a convection mode can be set by the number of rotations of the lower-side vibration motor 4, the disposition of the imbalance weight 43, and the like.

Then the support shaft 6 is tightened in the center hole 15 from the rear surface side of the disc portion 11 of the vehicle wheel 1, the vehicle wheel 1 is situated transversely while the rear surface of the disc portion 11 is oriented upward, the vehicle wheel 1 is located coaxially with the center line of the polishing medium storage tank 2, and the vehicle wheel 1 is put in the polishing medium 3 from the opening in the upper portion of the vibrating polishing medium storage tank 2. At this point, the vehicle wheel 1 is dipped in the polishing medium 3 in the polishing medium storage tank 2 such that the rim portion 12 is disposed between the upward flow and the downward flow of the polishing medium 3 by the convection, the polishing medium 3 is caused to flow inside and outside the vehicle wheel 1, and the polishing medium 3 is caused to flow so as to pass through the window hole 13 of the disc portion 11 (see FIGS. 1 and 3). Therefore, the polishing medium 3 can actively come into contact with not only the outside surface of the vehicle wheel 1 but also the inside surface by the vortex flow and the convection of the vertical flow of the polishing medium 3, which are generated by vibrating the polishing medium storage tank 2, and the polishing medium 3 can also actively come into contact with the window hole 13 of the disc portion 11.

At this point, preferably the diameter of the polishing medium storage tank 2 is set to 1.2 to 1.8 times the rim diameter of the vehicle wheel 1, and more preferably the diameter of the polishing medium storage tank 2 is set to 1.4 to 1.8 times the rim diameter of the vehicle wheel 1. When the diameter of the polishing medium storage tank 2 is lower than 1.2 times the rim diameter of the vehicle wheel 1, possibly the convection of the polishing medium 3 is actively generated only inside the vehicle wheel 1. When the diameter of the polishing medium storage tank 2 exceeds 1.8 times the rim diameter of the vehicle wheel 1, possibly the convection of the polishing medium 3 is actively generated only outside the vehicle wheel 1. Accordingly, when the diameter of the polishing medium storage tank 2 is set to 1.2 to 1.8 times the rim diameter of the vehicle wheel 1, the convection of the polishing medium 3 can securely be generated along the inside and outside surfaces of the vehicle wheel 1. Specifically the polishing medium storage tank 2 whose diameter ranges from 600 mm to 900 mm is used when the vehicle wheel 1 has the rim diameter of 500 mm. That is, a gap between the outside surface of the vehicle wheel 1 and the inner wall surface of the polishing medium storage tank 2 is adjusted so as to range from 50 mm to 200 mm.

As to the position in which the vehicle wheel 1 is put in the polishing medium storage tank 2, the vehicle wheel 1 is dipped in the polishing medium 3 in the polishing medium storage tank 2 to a depth in which the polishing medium 3 moves between the center portion and the outer circumferential portion in the bottom portion of the polishing medium storage tank 2 located below the vehicle wheel 1 while the polishing medium 3 exceeds the upper end of the rim portion 12 to move between the outside and the inside of the wheel. Therefore, the polishing medium 3 in the polishing medium storage tank 2 moves securely and well between the center portion and the outer circumferential portion in the upper and lower portions of the vehicle wheel 1, so that the convection of the polishing medium 3 can securely be generated along the inside and outside surfaces of the vehicle wheel 1.

In such cases, the position in which the vehicle wheel 1 is put in is properly set according to the size and type of the polishing medium 3, the number of rotations of the lower-side vibration motor 4, the oscillation angle of the polishing medium storage tank 2, and the like, and in a state of stillness in the polishing medium storage tank 2, the vehicle wheel 1 is put in the polishing medium storage tank 2 at the depth in which a clearance between the lower surface of the vehicle wheel 1 and the bottom portion of the polishing medium storage tank 2 becomes at least an average height of the polishing medium 3. A filling amount of the polishing medium 3 in the polishing medium storage tank 2 may be a filling amount in which the polishing medium 3 exceeds the upper end of the rim portion 12 of the vehicle wheel 1 to move between the wheel outside and the wheel inside during the vibration of the polishing medium storage tank 2 or a filling amount in which the polishing medium 3 does not reach the upper end of the rim portion 12 during stillness in the polishing medium storage tank 2.

Figure 3:
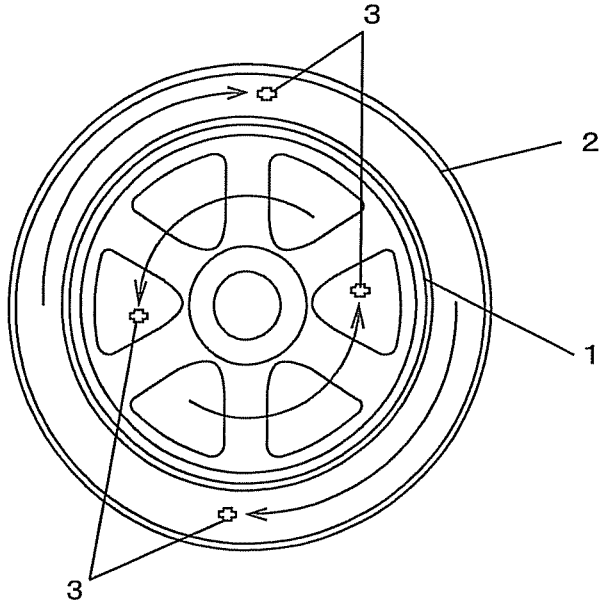
FIG. 3 is a schematic diagram illustrating a state in which a polishing medium flows in a polishing medium storage tank.
Figure 3:
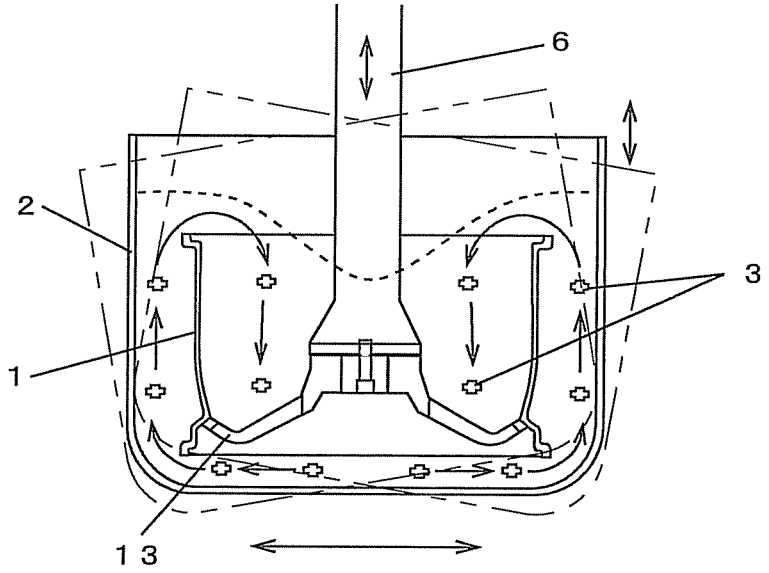

The upper-side vibration motor 8 is driven to symmetrically oscillate the support shaft 6 in relation to the polishing medium storage tank 2, thereby vibrating the vehicle wheel 1. Therefore, as illustrated in FIG. 3, the vehicle wheel 1 is vibrated while the convection is generated. In the convection, the polishing medium 3 that flows in the vortex manner in the polishing medium storage tank 2 is caused to flow upward from the wheel outside and introduced to the wheel inside, the polishing medium is caused to flow downward in the wheel inside, the polishing medium 3 is passed through the window hole 13 of the disc portion 11 and caused to flow to the bottom portion of the polishing medium storage tank 2. Therefore, the surface pressure and density of the polishing medium 3 that comes into contact with the outside surface, inside surface, and window hole 13 of the vehicle wheel 1 can increase by vibrating the vehicle wheel 1 through the support shaft 6. Accordingly, the whole inside and outside surfaces of the vehicle wheel 1 having the complicated three-dimensional shape can evenly be polished, the burrs of the window hole 13 can be taken well, and the polishing can be performed in a shorter time than ever before (for example, 10 minutes or less compared with the conventional polishing time of 30 minutes). As to the direction in which the upper-side vibration motor 8 is rotated, preferably the direction of the rotation generated by the oscillation of the vehicle wheel 1 is opposite to the direction of the vortex rotation of the polishing medium 3 in order that the polishing medium 3 collides drastically with the vehicle wheel 1, or the direction of the rotation may be identical to direction of the vortex rotation of the polishing medium 3.

As described above, according to the vibration polishing, the whole inside and outside surfaces of the vehicle wheel 1 having the complicated three-dimensional shape can evenly be polished and the polishing can be performed in a shorter time than ever before. Additionally, the burrs of the window hole 13 can be taken well by bringing the polishing medium 3 into active contact with the window hole 13 of the disc portion 11.

In the vibration polishing apparatus 10, the upper unit **10*b* is placed in the sub-frame 92 while the lower unit 10*a* is placed in the base frame 91, and the sub-frame 92 is detachably wedge fitted in the upper end of the base frame 91, thereby being able to prevent the turning of the upper unit 10*b*. The turning of the upper unit 10*b* is generated due to an influence of a torque of the vortex flow of the polishing medium 3 in the polishing medium storage tank 2 by the vibration of the polishing medium storage tank 2. Accordingly, the convection of the polishing medium 3 can securely be generated, and the inside and outside surfaces of the vehicle wheel 1 can evenly be polished in a short time. The sub-frame 92 is detachably wedge fitted in the upper end of the base frame 91, which allows the vehicle wheel 1 to be easily accommodated in the polishing medium storage tank 2** in the proper direction and the proper position.

Further, because the sub-frame 92, the upper-side support spring 94, the upper-side support frame 7, the support shaft 6, and the upper-side vibration motor 8 are integrated to form the upper unit 10*b*, the vehicle wheel 1 is dipped in and taken out from the polishing medium storage tank 2 by the simple work that attach the vehicle wheel 1 to the lower end of the support shaft 6 to attach and detach the sub-frame 92 to and from the base frame 91.

Second Embodiment

Figure 5:
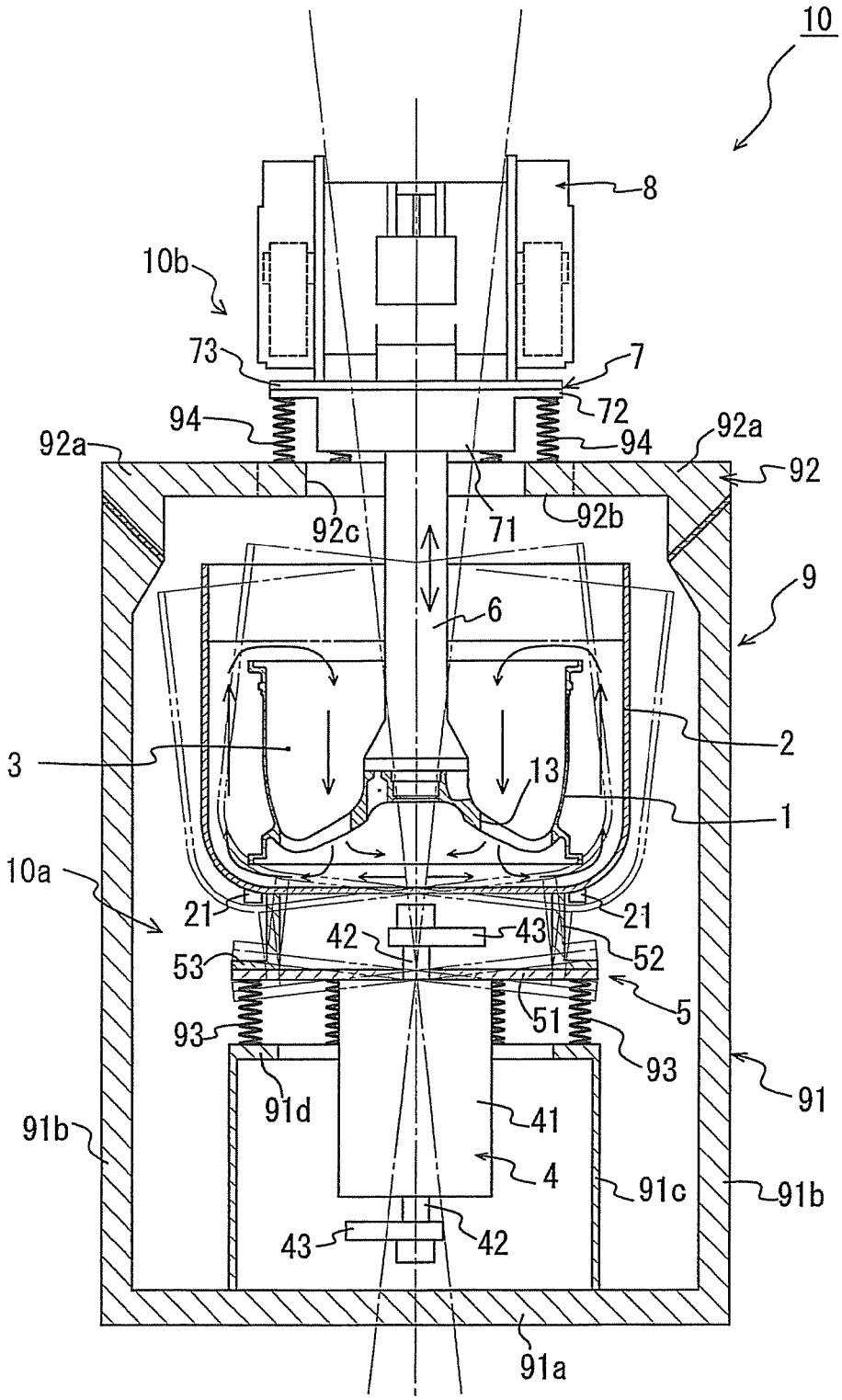
FIG. 5 is a sectional view illustrating an entire configuration of a vehicle wheel vibration polishing apparatus according to a second embodiment of the present invention.

In the first embodiment, the upper-side vibration motor 8 and the rotating shaft 82 are disposed coaxially with the support shaft 6 and the center of the polishing medium storage tank 2. On the other hand, in a vibration polishing apparatus 10 according to a second embodiment of the present invention, as illustrated in FIG. 5, the motor fixing portion 73 of the upper-side support frame 7 is formed into a plate shape, the upper-side vibration motor 8 is transversely placed, and the rotating shaft 82 is disposed in the direction orthogonal to the support shaft 6 so as to pass through the shaft center of the support shaft 6. Therefore, the support shaft moves vertically by driving the upper-side vibration motor 8, thereby vertically vibrating the vehicle wheel 1. The profile of the apparatus can be suppressed to a lower level by transversely placing the upper-side vibration motor 8. The rest of the structures is similar to those of the first embodiment, the same functional effect is obtained.

Other Embodiments

Figure 6:
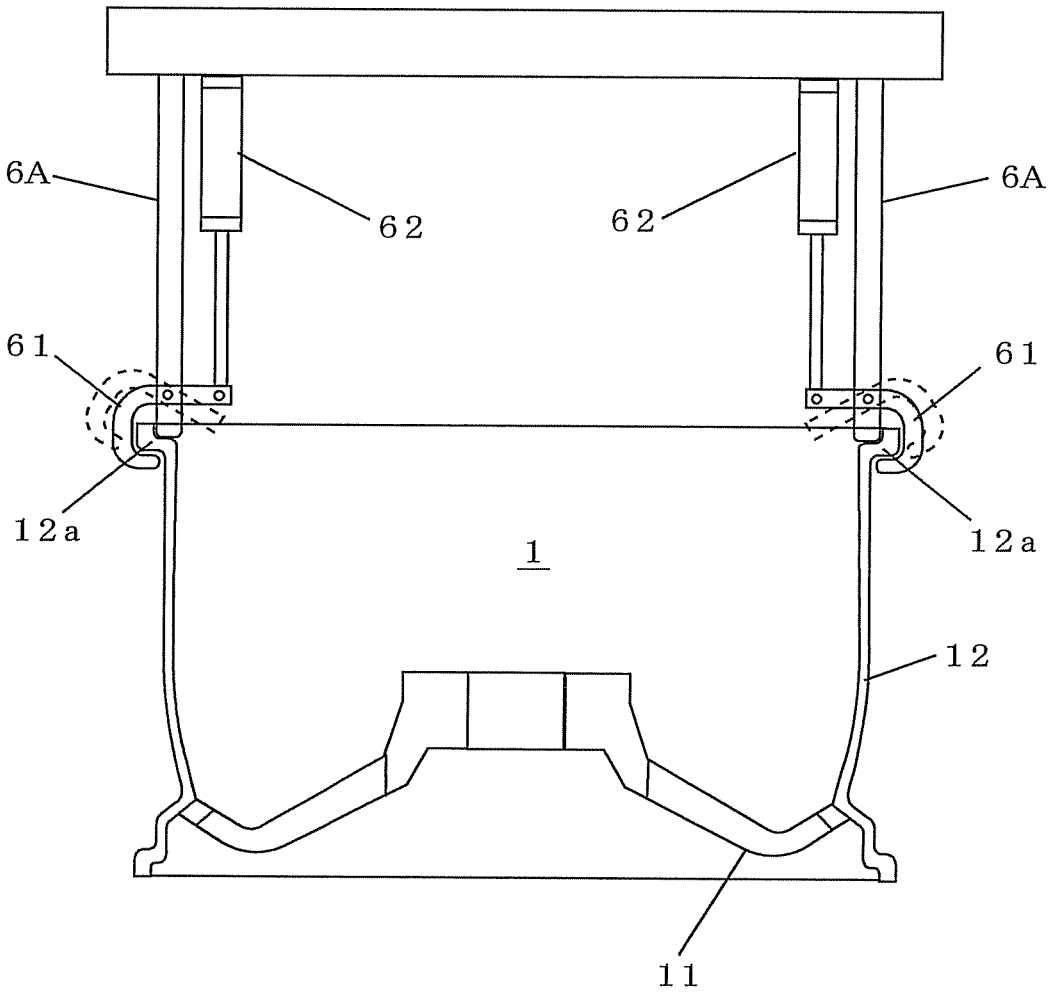
FIG. 6 is a schematic diagram illustrating another example of a support shaft.

For example, as illustrated in FIG. 6, the support shaft 6A may be formed by a plurality of support shafts 6A including grasping mechanisms that grasp a flange 12*a* at the upper end of the rim portion. In such cases, the grasping mechanism can include a cam 61 that is driven by a proceeding and retreating mechanism 62 such as a hydraulic cylinder. Therefore, the work that attaches and detaches the vehicle wheel 1 in the support shaft 6A can be automated, the vehicle wheel 1 is delivered to and received from an installed pick-up robot before and after the polishing, and therefore the automation of the whole polishing work is advantageously achieved.

In the embodiments, the lower-side vibration motor 4 is coaxially connected to the rotating shaft 42 in which the imbalance weight 43 is provided. Alternatively, the lower-side vibration motor is vertically provided beside the polishing medium storage tank 2, the rotating shaft 42 is rotatably journaled in the fixing plate 51, a belt is entrained between the motor rotating shaft of the lower-side vibration motor and the rotating shaft 42 in which the imbalance weight 43 is provided or a gear is engaged between the motor rotating shaft and the rotating shaft 42, and the rotating shaft 42 may be rotated to rotate the imbalance weight 43. Therefore, the height of the apparatus can be suppressed by eliminating the lower-side vibration motor from portion below the polishing medium storage tank 2.

In bringing or taking out the vehicle wheel 1 in or from the polishing medium storage tank 2, the upper unit 10*b* may be conveyed while retained by an externally placed robot.

The upper unit 10*b* may be turned within a range of 90 degrees to 180 degrees such that the vehicle wheel 1 is easily attached and detached.

The power supply to the upper-side vibration motor 8 may be controlled in synchronization with the coupling and releasing of the upper unit 10*b* such that the power feeding is performed to drive the upper-side vibration motor 8 when the upper unit 10*b* is coupled to the lower unit 10*a*, and such that the power feeding is stopped to stop the driving of the upper-side vibration motor 8 when the upper unit 10*b* is released from the lower unit 10*a*.

The present application claims a priority based on a Japanese Patent Application No. 2009-276056 filed on Dec. 4, 2009, the content of which is hereby incorporated by reference in its entirely.

What is claimed is:

1. A method for polishing a vehicle wheel having a three-dimensional shape, the vehicle wheel including a disc-shaped disc portion in which a plurality of window holes are provided and a cylindrical rim portion that is located around the disc portion, the method comprising:

oscillating a bottomed cylindrical polishing medium storage tank to vibrate the polishing medium storage tank, a polishing medium being stored in the polishing medium storage tank; causing the polishing medium in the polishing medium storage tank to flow in a vortex manner; generating a convection in which the polishing medium flows downward in a center portion of the vortex while flowing upward in an outer circumferential portion or a convection in which the polishing medium flows upward in the center portion of the vortex while flowing downward in the outer circumferential portion;

connecting a support shaft from a back side of the vehicle wheel; transversely situating the vehicle wheel with a rear surface of the disc portion oriented upward; dipping the vehicle wheel in the polishing medium of the polishing medium storage tank such that the rim portion is disposed between an upward flow and a downward flow of the polishing medium by the convection; causing the polishing medium to flow outside and inside the vehicle wheel; causing the polishing medium to flow so as to pass through the window holes of the disc portion; and vibrating the vehicle wheel through the support shaft to vibration polishing the vehicle wheel;

wherein a length of a line extending from a periphery of the polishing medium storage tank to an opposite side periphery is set to 1.2 to 1.8 times a rim diameter of the vehicle wheel.

2. The method for vibration polishing the vehicle wheel according to claim 1, wherein the vehicle wheel is dipped in the polishing medium in the polishing medium storage tank to a depth in which the polishing medium moves between a center portion and an outer circumferential portion in a bottom portion of the polishing medium storage tank located below the vehicle wheel while the polishing medium exceeds an upper end of the rim portion to move between the outside and the inside of the vehicle wheel.

3. The method for vibration polishing the vehicle wheel according to claim 1, wherein the vehicle wheel is located coaxially with a center line of the polishing medium storage tank, and the vehicle wheel is vibrated by vertical movement of the support shaft.

4. The method for vibration polishing the vehicle wheel according to claim 1, wherein the vehicle wheel is located coaxially with a center line of the polishing medium storage tank, and the vehicle wheel is vibrated by oscillating the support shaft in relation to the polishing medium storage tank.

* * * * *

UNITED STATES PATENT AND TRADEMARK OFFICE

CERTIFICATE OF CORRECTION

PATENT NO. : 8,662,960 B2
APPLICATION NO. : 12/913978
DATED : March 4, 2014
INVENTOR(S) : Shujiro Inatani and Tomoyuki Murakami It is certified that error appears in the above-identified patent and that said Letters Patent is hereby corrected as shown below:

Title page, item (73) Assignees:

Ray's Engineering Co., Ltd, Osaka (JP)

It should read:

(73) Assignees:

Rays Engineering Co., Ltd, Osaka (JP)

Signed and Sealed this
Thirtieth Day of September, 2014

Michelle K. Lee

Michelle K. Lee
*Deputy Director of the United States Patent and Trademark Office*